US010532959B2

(12) United States Patent
Quintana Angulo et al.

(10) Patent No.: US 10,532,959 B2
(45) Date of Patent: Jan. 14, 2020

(54) METHOD FOR THE "ON-SITE" MANUFACTURE OF WATER-RESISTANT LOW-DENSITY WATER-GEL EXPLOSIVES

(71) Applicant: Maxamcorp Holding, S.L., Madrid (ES)

(72) Inventors: Jose Ramon Quintana Angulo, Galdacano-Vizcaya (ES); Fernando Beitia Gomez De Segura, Madrid (ES); Arturo Carranza Vitores, Galdacano-Vizcaya (ES)

(73) Assignee: MAXAMCORP HOLDINGS, S.L, Madrid (ES)

( * ) Notice: Subject to any disclaimer, the term of this patent is extended or adjusted under 35 U.S.C. 154(b) by 40 days.

(21) Appl. No.: 14/780,172

(22) PCT Filed: Mar. 27, 2014

(86) PCT No.: PCT/EP2014/056200
§ 371 (c)(1),
(2) Date: Sep. 25, 2015

(87) PCT Pub. No.: WO2014/154824
PCT Pub. Date: Oct. 2, 2014

(65) Prior Publication Data

US 2016/0052834 A1 Feb. 25, 2016

(30) Foreign Application Priority Data

Mar. 27, 2013 (EP) ..... 13382114

(51) Int. Cl.
*C06B 21/00* (2006.01)
*C06B 23/00* (2006.01)
(Continued)

(52) U.S. Cl.
CPC ..... *C06B 21/0008* (2013.01); *C06B 23/004* (2013.01); *C06B 31/28* (2013.01); *C06B 47/14* (2013.01); *F42B 99/00* (2013.01)

(58) Field of Classification Search
CPC ..... C06B 21/0008; C06B 23/004
See application file for complete search history.

(56) References Cited

U.S. PATENT DOCUMENTS 3,288,658 A 11/1966 Ferguson et al.
3,308,738 A 2/1967 Clay et al.
(Continued)

FOREIGN PATENT DOCUMENTS

EP 0194775 A1 9/1986
EP 0203230 A1 12/1986
(Continued)

OTHER PUBLICATIONS

Reif—https://users.cs.duke.edu/~reif/courses/molcomplectures/Kinetics/KineticsOverview/KineticsOverview.pdf Slides 1-14 (Year: 2014).*

(Continued)

*Primary Examiner* — Leith S Shafi
*Assistant Examiner* — Nicholas R Krasnow
(74) *Attorney, Agent, or Firm* — Lucas & Mercanti, LLP

(57) ABSTRACT

Manufacture is carried out in a continuous manner while simultaneously loading the blast holes in a device with mixing capability where (a) a less sensitive or non-explosive water-based matrix containing a cross-linkable polymer, (b) a cross-linking agent for cross-linking the polymer contained in the matrix, (c) a gas-generating agent, are mixed. The presence of the polymer distributed uniformly in the matrix together with the cross-linking agent results in a three-dimensional network formed by molecular polymer chains bound to one another in a short period of time after (Continued)

mixing. The process can be performed in trucks for loading explosives in blast holes having compartments for the different components of the mixture and one or several mixing devices allowing the manufacture of the final mixture which would be unloaded into the blast holes either by means of a pump or an auger.

14 Claims, 4 Drawing Sheets

(51) Int. Cl.

| | |
|---|---|
| ***C06B 47/14*** | (2006.01) |
| ***C06B 31/28*** | (2006.01) |
| ***F42B 99/00*** | (2006.01) |

(56) References Cited

U.S. PATENT DOCUMENTS 3,338,033 A 8/1967 Ross
3,390,030 A 6/1968 Fee et al.
3,523,048 A 8/1970 Hopler, Jr.
3,610,088 A 10/1971 Christensen et al.
3,617,401 A 11/1971 Mortensen et al.
3,640,585 A * 2/1972 Hamilton ..... B65G 53/30 406/46
3,653,992 A * 4/1972 Fee ..... C06B 47/14 149/2
3,832,545 A * 8/1974 Bartko ..... G01V 5/0008 376/159
3,995,673 A * 12/1976 Grigaitis ..... C06B 47/14 149/21
4,008,108 A * 2/1977 Chrisp ..... B01F 3/04992 149/2
4,026,738 A * 5/1977 Richard ..... C06B 47/14 149/44
4,077,820 A * 3/1978 Bolza ..... A01N 25/10 149/109.4
4,305,766 A * 12/1981 Edmonds ..... C06B 47/14 149/2
4,357,184 A * 11/1982 Binet ..... C06B 47/145 149/2
4,369,689 A * 1/1983 Donaghue ..... B01F 5/0256 118/303
4,434,017 A * 2/1984 Smith ..... C06B 21/005 149/2
4,456,492 A * 6/1984 Alexander ..... C06B 31/285 149/8
4,555,278 A 11/1985 Cescon et al.
4,564,404 A * 1/1986 Fremaux ..... C06B 47/14 149/109.6
4,676,849 A * 6/1987 Curtin ..... C06B 21/0008 149/109.6
5,490,887 A 2/1996 Cranney et al.
6,027,588 A * 2/2000 Vattipalli ..... C06B 23/004 149/109.6
6,949,153 B2 9/2005 Gomez de Segura et al.
2002/0129881 A1* 9/2002 Rivas ..... C06B 21/0008 149/109.6
2004/0016481 A1* 1/2004 Gomez de Segura ..... C06B 21/0008 149/46
2011/0120603 A1* 5/2011 Perez Cordova ..... C06B 47/145 149/46

FOREIGN PATENT DOCUMENTS

EP 0568387 A1 11/1993
EP 1002777 A1 5/2000
EP 1207145 A1 5/2002
EP 1375456 A2 1/2004
GB 2058740 A 4/1981
WO 97/24298 A1 7/1997

OTHER PUBLICATIONS

International Search Report dated May 9, 2014 for Application No. PCT/EP2014/056200.

* cited by examiner

METHOD FOR THE "ON-SITE" MANUFACTURE OF WATER-RESISTANT LOW-DENSITY WATER-GEL EXPLOSIVES

CROSS REFERENCE TO RELATED APPLICATION

This Application is a 371 of PCT/EP2014/056200 filed on Mar. 27, 2014 which, in turn, claimed the priority of European Patent Application No. 13382114.0 filed on Mar. 27, 2013, both applications are incorporated herein by reference.

FIELD OF THE INVENTION

The present invention is comprised in the category of civil explosives for use in mining and public works. More specifically, it relates to a method for the "on-site" manufacture of water-based explosive mixtures from a non-explosive matrix containing a cross-linkable polymer, a gas bubble-generating agent, a cross-linking agent, and optionally an oxidizer or a mixture of an oxidizer and a fuel material in granular form.

BACKGROUND OF THE INVENTION

The use of explosives in public works and mining is so widespread that performing said activities without using them would be inconceivable today. Given the nature of these products and the amounts used, safety aspects both in their handling and transport to the site of use are very important and form a very important area of activity in the research and development of these technologies.

The market has evolved from using generally detonator-sensitive products packed in cartridges to using much less sensitive bulk products that must be initiated with a booster. "On-site" manufacture or sensitization is favored to facilitate transport to the site of use.

The earliest patents relating to "on-site" explosive manufacture, i.e., the manufacture of the explosive in the same truck used for unloading the explosive into the blast holes, were filed by IRECO (U.S. Pat. Nos. 3,303,738 and 3,338,033). These patents describe the manufacture of a water-gel-type explosive in a truck by means of metering and mixing a liquid solution containing oxidizing salts with a solid material containing oxidizing salts and thickeners. U.S. Pat. No. 3,610,088 (IRECO) describes the same method as the preceding patents for the "on-site" manufacture of a water-gel, incorporating the simultaneous addition of air either by means of mechanical trapping or by means of generating a gas through a chemical reaction. Patent EP 0 203 230 (IRECO) describes a blender having mobile and fixed blades allowing the "on-site" manufacture of a water-in-oil emulsion-type blasting agent.

The greatest drawback of these earliest "on-site" manufacturing technologies lies in the fact that they use high-temperature oxidizing salt solutions that must be transported with a heat supply in thermally insulated tanks. The complexity of the truck and of the manufacturing operation requires highly qualified staff to assure its success.

The emergence of emulsions changed the trend towards the transport of matrix emulsions classified as non-explosive emulsions and their "on-site" sensitization either by means of mixing with hollow microspheres or by means of generating gas through a chemical reaction. Based on the same philosophy, MAXAM (formerly known as Unión Española de Explosivos) developed a series of technologies based on the transport of a non-explosive matrix suspension and its "on-site" sensitization by means of incorporating air to the matrix before unloading it into the blast hole.

European patent EP1002777 B1 (MAXAM, formerly known as Unión Española de Explosivos) describes a method and an installation for the "on-site" sensitization of water-based explosives before loading the blast holes from a non-explosive matrix suspension. The sensitization is carried out by means of mixing metered amounts of the matrix product with a gas or air and a gas bubble stabilizer. Likewise, European patent EP1207145 B1 (MAXAM, formerly known as Unión Española de Explosivos) discloses a method for the "on-site" manufacture of water-based explosives before loading the blast holes from an oxidizing matrix suspension with an oxygen balance greater than +14%, a fuel material, a gas or air and a gas bubble stabilizer. U.S. Pat. No. 6,949,153 B2 (MAXAM, formerly known as Unión Española de Explosivos) describes a method for the "on-site" manufacture of pumpable explosive mixtures by means of mixing a granular oxidizer with a non-explosive matrix suspension stabilized with a thickener, air and a gas bubble stabilizer which allows regulating the density of the end product according to the process conditions. This method allows controlling the density of the explosive product before unloading into the blast holes by means of the controlled incorporation of atmospheric air by mechanical means.

Another alternative is the transport of the matrix product and its sensitization at the site of use by means of mixing the matrix with low-density granulated nitrates or with the mixture of ammonium nitrate with a liquid hydrocarbon (ANFO). U.S. Pat. No. 4,555,278 and EP 0 194 775 describe explosives of this type formed from emulsions and water-gels, respectively. The sensitization in such explosives, known as "heavy ANFOs", is due to the actual porosity of the porous ammonium nitrate granules and to the entrapped air between the gaps thereof. Such mixtures are not pumpable, the blast holes are loaded by means of augers and their water resistance is very limited. The nitrate particle content is generally greater than 50% given that for lower contents the resulting mixture is very dense since the liquid matrix occupies the spaces between the granules, the mixture having too low initiation sensitivity.

The use of explosives in mining or public works may lead to the event where, due to the characteristics of the rock and/or of the geological structure of the terrain, the optimal explosive that must be used has to have a low-density (0.4-0.8 g/cm$^3$) and low detonation velocity (2-4 km/s). ANFO is the most frequently used explosive even though it is included in the higher end of the density range (0.8 g/cm$^3$). When the density of the ANFO is to be reduced, it is mixed with a low-density granular material which can be inorganic and therefore inert, or organic, and in this case it also has a fuel function. The use of standard or low-density ANFOs is limited only to the case of dry blast holes because these explosives are not water-resistant.

When blast holes contain water, heavy ANFOs (mixtures of matrix and ANFO with a high ANFO content) or doped emulsions (mixtures of matrix and ANFO with a low ANFO or granular nitrate content) are normally used. In the first case, the resulting explosive has a density greater than that of the ANFO because the emulsion is located in the space between the ANFO granules. This is also why the water resistance is very limited and the prolonged stay of the explosive into the blast hole can cause the gases originating from the subsequent detonation thereof to have a high nitrogen oxide (red smoke) content.

In the case of doped explosive emulsions, the resistance of the explosive to water is assured due to the excessive emulsion. However, this solution has a serious drawback. If the matrix emulsion is sensitized by means of chemically generating gas bubbles and the final density of the explosive is therefore controlled by the total volume of these bubbles, the average density of the explosive into the blast hole is generally not very low, and the density will be higher the greater the height of the blast hole. Due to the hydrostatic pressure along the explosive column in the blast hole, gas from bubbles located at the bottom of the blast hole is highly compressed and the density of the explosive is relatively high in the bottom part of the blast hole. To compensate this effect, the volume of gas generated is increased by means of chemical gassing, resulting in an explosive with a very low-density at the top part of the blast hole. However, this solution is very limited because an excessively low density at the top part of the blast hole causes a very significant reduction in the consistency of the final explosive, leading to the collapse of the explosive column or facilitating the introduction of the stemming material in the explosive column. This phenomenon prevents being able to achieve relatively low average densities in the blast hole by means of this solution. The solution used for reducing the density in these cases consists of adding very low-density solid particles to the emulsion. This option in turn has other drawbacks in addition to a significant raw material cost increase. If these particles are added to the matrix in the factory, the matrix is no longer non-explosive, and a bulk explosive must therefore be transported. If in contrast these hollow particles are added "on-site" in the truck, the truck to be used is more complex and has smaller capacity due to the considerable volume of the compartment containing the solid density-reducing agent and to the actual metering thereof.

BRIEF DESCRIPTION OF THE INVENTION

The present invention eliminates all or part of the drawbacks mentioned above and allows manufacturing a low-density water-resistant explosive in a more economical and safe manner. The object of the invention is a method for the continuous "on-site" manufacture of a water-resistant explosive while simultaneously loading the blast holes, where (a) a non-explosive water-based matrix containing a cross-linkable polymer, (b) a cross-linking agent for cross-linking the polymer contained in the matrix, (c) a gas-generating agent, and optionally (d) a pH-regulating agent, optionally (e) a gas/air bubble-stabilizing agent, and also optionally (f) an oxidizer in granular form and (g) a fuel substance, are mixed together. The presence of the polymer distributed uniformly in the matrix together with the cross-linking agent results in a three-dimensional network formed by molecular polymer chains bound to one another in a relatively short period of time after mixing. This polymer network has three essential functions: (a) fixing the gas bubbles formed, preventing their migration and therefore keeping the final low density constant, (b) providing the final explosive with enough mechanical strength preventing the product from collapsing due to the actual weight of the explosive column and preventing the stemming material from entering the explosive column despite the significant volume of gas/air contained in the explosive, and (c) for providing a physical barrier against external water making the explosive water-resistant enough so that the explosive can remain loaded in the blast hole for relatively long periods without producing red smoke during subsequent detonation. The chemical gas bubble generation and polymer chain cross-linking process rates are controlled such that virtually the whole gas is generated before the viscous liquid, which is the mixture that is loaded into the blast hole, is transformed into an elastic solid as a result of the three-dimensional polymer network formation. The resulting explosive is thus allowed to suitably expand in the blast hole and reach the chosen density. The method can be performed in trucks for loading explosives into blast holes having compartments for the different components of the mixture and one or several mixing devices allowing the manufacture of the final mixture which would be unloaded into the blast holes either by means of a pump or an auger.

DETAILED DESCRIPTION OF THE INVENTION

Figure 1:
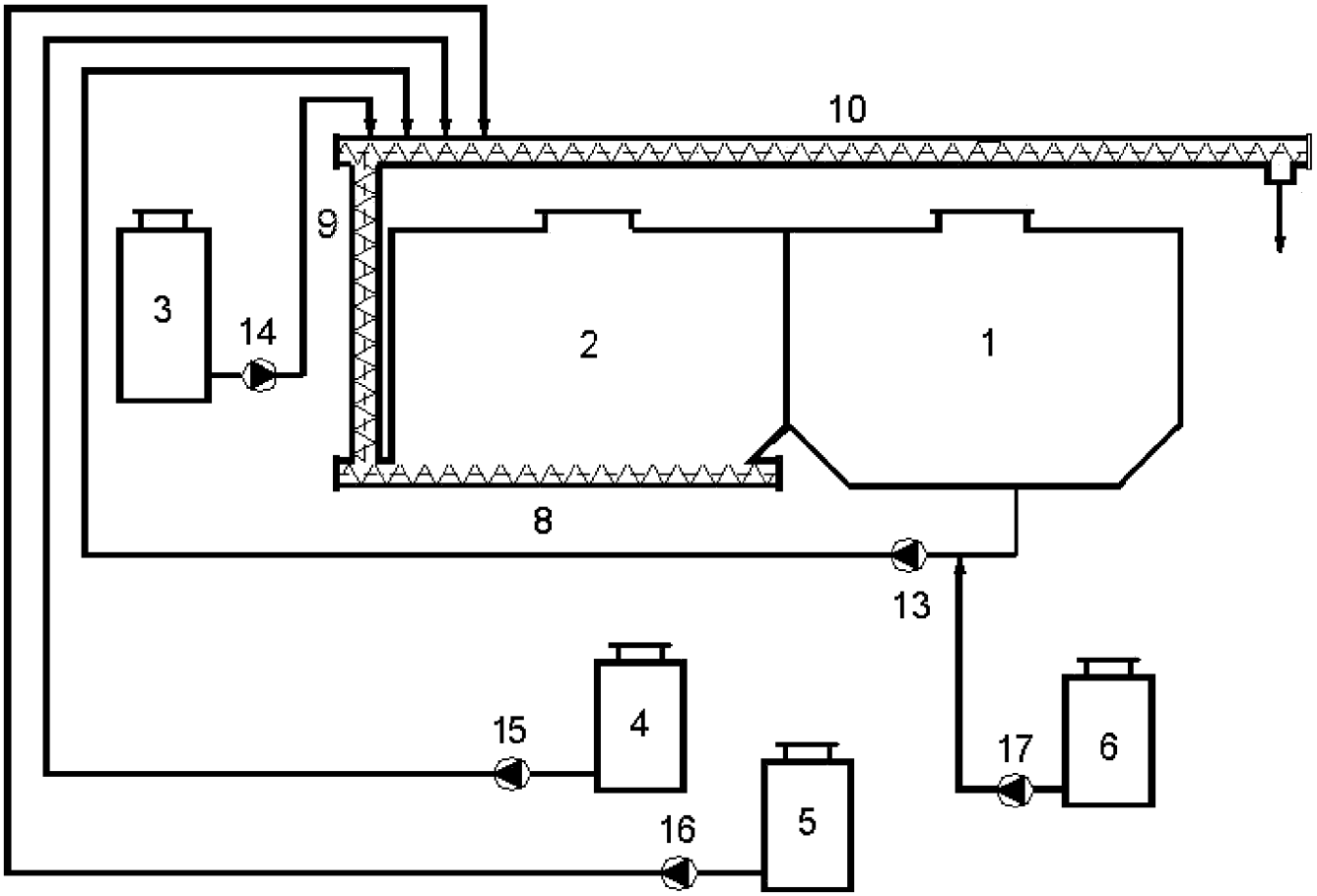
FIGS. 1 and 2 show two diagrams of two particular embodiments of installations for the "on-site" manufacture of explosive mixtures according to the present invention.

The invention provides a method for the "on-site" manufacture of a water-resistant low-density water-gel explosive, hereinafter "method of the invention", which comprises:

a) transporting to the manufacturing site:
   (i) a non-explosive or low-sensitivity matrix product comprising an aqueous solution or suspension of at least one oxidizing salt, and at least one cross-linkable water-soluble polymer;
   (ii) a gas bubble-generating agent; and
   (iii) a cross-linking agent capable of cross-linking at least one cross-linkable water-soluble polymer contained in said matrix;
b) mixing said products (i), (ii) and (iii) in at least one device with mixing capability to obtain a mixture which can be conveyed by means of a pump or an auger,
c) loading the mixture resulting from b) directly into a blast hole by means of a pump or an auger; and
d) generating gas bubbles by means of said gas bubble-generating agent and cross-linking said polymer by means of said cross-linking agent within the mixture already introduced in the blast hole, under conditions in which the chemical cross-linking process is slower than the chemical bubble-generating process, and wherein the final density of the explosive is regulated with the concentration of the gas bubble-generating agent and the final physical consistency of the explosive is regulated with the cross-linking agent.

In the sense used in this description, "on-site manufacture" refers to producing the explosive at the site where it will be used from the mixture of its components, generating a mixture before unloading it into the blast holes where it will be used. This means that the different components forming said mixture are mixed "on-site" in a transportable installation, for example, in a truck, instead of a fixed installation generally located a significant distance away from the site intended for the use of the explosive. The explosive (end product) is produced inside the blast hole, where the mixture acquires the final density and consistency once introduced in the blast holes.

The non-explosive or low-sensitivity matrix product, hereinafter referred to as matrix product, is a water-based product comprising water, at least one oxidizing salt, and at least one cross-linkable water-soluble polymer. Optionally, said matrix product can also contain a fuel material and/or a sensitizer. The matrix product is transported to the "on-site" manufacturing site in a suitable container such as a tank or reservoir.

Ammonium nitrates, chlorates and perchlorates of alkaline metals or alkaline-earth metals and mixtures thereof can be used as oxidizing salts. Non-limiting illustrative examples of said salts include, among others, ammonium, sodium, potassium, lithium, magnesium or calcium nitrates, chlorates and perchlorates. The total concentration of oxidizing salts can range between 50% and 90% by weight of the matrix product, preferably between 60% and 80%.

Natural or synthetic products, for example, natural products derived from seeds, cellulose derivatives or synthetic polymers and mixtures thereof, can be used as cross-linkable water-soluble polymers. More specifically, these polymers can be, among others, galactomannans such as guar gum, etc., or carboxymethyl cellulose and derivatives thereof. Additional examples of water-soluble polymers can be found in the "Handbook of Water-Soluble Gums and Resins", Robert L. Davidson, ed.; McGraw Hill, Inc. (1980). The person skilled in the art will understand that said polymers can be modified if necessary to introduce the functional groups suitable for cross-linking. The total concentration of dissolved polymer can range between 0.1% and 5% by weight of the matrix product, preferably between 0.4% and 3%.

If desired, the matrix product can contain one or more fuel materials. The fuel materials which are optionally present in the matrix product can be liquids or solids, for example, organic compounds belonging to the group consisting of saturated or unsaturated aromatic hydrocarbons and aliphatic hydrocarbons, oils, petroleum products, or products of plant origin such as starches, flour, sawdust, molasses and sugars, or also finely divided metal fuels, such as aluminum, silicon or ferrosilicon. The matrix product can optionally contain mixtures of the mentioned fuel materials. Generally, the total concentration of fuel material in the matrix product, if it contains fuel materials, can range between 1% and 20% by weight of the matrix product, preferably between 3% and 10%. Taking into account that the mixture obtained by means of the method of the invention which is loaded into the blast hole can contain one or more fuel materials, if the matrix product did not contain said fuel material or materials, it would be necessary to add them into the mixing installation.

The matrix product contains one or more sensitizers if desired. The optional sensitizers can be those commonly used in manufacturing of such water-based explosives. In a particular embodiment, said sensitizers can be alkylamine nitrates, such as for example methylamine nitrate, dimethylamine nitrate, etc., or alkanolamine nitrates, such as for example ethanolamine nitrate, diethanolamine nitrate, triethanolamine nitrate, etc., as well as nitrates of other water-soluble amines such as hexamine, diethylenetriamine, ethylenediamine and mixtures thereof. The total concentration of sensitizers in the matrix product, if it contains them, can range between 0.5% and 40% by weight of the matrix product, preferably between 2% and 30%.

The matrix product can be present in the mixture which is loaded into the blast hole with a minimum percentage of 30%, preferably greater than or equal to 40% by weight with respect to the total weight of said mixture. Although reference is made to the percentage with respect to the mixture which is loaded into the blast hole [resulting from step b) of the method of the invention], the person skilled in the art will understand that said percentage by weight is maintained in the water-resistant low-density water-gel explosive produced inside the blast hole after loading said mixture. Therefore, the percentages by weight of the different components will be indicated indistinctly either by reference to the mixture which is loaded into the blast hole or by reference to the water-resistant low-density water-gel explosive produced inside the blast hole.

Peroxides, such as for example hydrogen peroxide, etc., carbonates, such as for example sodium bicarbonate, etc., nitrous acid or salts thereof, such as for example sodium nitrite, etc., nitrosamines, such as for example N,N-dinitroso pentamethylene tetramine, etc., and diisocyanates, can be used as a gas bubble-generating agent. The gas bubble-generating agent can be present in the mixture which is loaded into the blast hole at a concentration comprised between 0.01% and 3% by weight, preferably between 0.05% and 1% by weight with respect to the total weight of said mixture. The gas bubble-generating agent is transported to the "on-site" manufacturing site in a suitable container such as a tank.

Antimony compounds such as potassium pyroantimonate, antimony potassium tartrate, etc., or chromium compounds such as chromic acid, sodium or potassium dichromate, etc., or zirconium compounds such as zirconium sulfate or zirconium diisopropylamine lactate, etc., or titanium compounds such as titanium triethanolamine chelate, etc., or aluminum compounds such as aluminum sulfate, etc., can be used as a cross-linking agent (or reticulation agent). The person skilled in the art will understand that the cross-linking agent suitable for cross-linking the polymer chains of the cross-linkable water-soluble polymer will be chosen. The cross-linking agent can be present in the mixture which is loaded into the blast hole at a concentration comprised between 0.01% and 5% by weight, preferably between 0.01% and 2% by weight with respect to the total weight of said mixture. The cross-linking agent is transported to the "on-site" manufacturing site in a suitable container such as a tank.

According to the method of the invention, if desired, (iv) a pH-regulating agent, and/or (v) a gas/air bubble-stabilizing agent, and/or (vi) an inorganic oxidizer in granular form or a mixture of an oxidizer in granular form and a solid or liquid fuel material, and/or (vii) a liquid fuel material can also be transported to the manufacturing site, and said product/products can be mixed with said non-explosive or low-sensitivity matrix product, the gas bubble-generating agent and the cross-linking agent. Therefore, in a particular embodiment, the method of the invention comprises transporting a pH-regulating agent to the manufacturing site. Inorganic acids such as nitric acid, hydrochloric acid, sulfamic acid, etc., or organic acids such as acetic acid, adipic acid, formic acid, citric acid, etc., can be used as a pH-regulating agent The pH-regulating agent can be present in the mixture which is loaded into the blast hole at a concentration suitable for providing the desired pH; even though the pH of the mixture which is loaded into the blast hole can vary within a wide range, in a particular embodiment, the pH of said mixture which is loaded into the blast hole is comprised between 2 and 5, preferably between 3 and 4. According to this particular embodiment, the pH-regulating agent is transported to the "on-site" manufacturing site in a suitable container such as a tank.

In another particular embodiment, the method of the invention comprises transporting a gas/air bubble-stabilizing agent to the manufacturing site. Surfactant solutions or dispersions such as fatty acid amine derivatives, such as for example lauryl amine acetate, etc., proteins such as for example egg albumin, lactalbumin, collagen, soy protein, guar protein or modified guar gum of the guar hydroxypropyl type, etc., or mixtures of said products can be used as a gas/air bubble-stabilizing agent. The concentration of gas/air bubble-stabilizing agent can range between 0.01% and 5% by weight with respect to the mixture which is loaded into the blast hole, preferably between 0.1% and 2% by weight. According to this particular embodiment, the gas/air bubble-stabilizing agent is transported to the "on-site" manufacturing site in a suitable container such as a tank.

In another particular embodiment, the method of the invention comprises transporting an inorganic oxidizer in granular form to the water-resistant low-density water-gel explosive manufacturing site. According to this particular embodiment, the mixture which is loaded into the blast hole contains said inorganic oxidizer in granular form. Inorganic nitrates, preferably ammonium nitrate, etc., can be used as inorganic oxidizers in granular form. In some cases the inorganic oxidizer in granular form can be a porous ammonium nitrate, a standard product in manufacturing explosives.

In another particular embodiment, the method of the invention comprises transporting a mixture of at least one inorganic oxidizer in granular form and at least one liquid or solid fuel material to the manufacturing site. According to this particular embodiment, the mixture which is loaded into the blast hole contains a mixture of an inorganic oxidizer in granular form and a fuel material (liquid or solid). In this particular embodiment, an inorganic nitrate such as inorganic oxidizer in granular form, for example, ammonium nitrate in granular form, etc., can be used. Either a liquid fuel material such as gas oil, etc., or a solid fuel material such as granular aluminum, rubber, etc., can be used as a fuel material. In a particular embodiment, said mixture of an inorganic oxidizer in granular form and a (liquid or solid) fuel material contains an inorganic nitrate in granular form and a liquid fuel material, particularly a mixture of ammonium nitrate and gas oil. Once at the water-resistant low-density water-gel explosive "on-site" manufacturing site, said components [the inorganic oxidizer in granular form and the liquid or solid fuel material] can be mixed with one another before contacting them with the matrix product, the gas bubble-generating agent and the cross-linking agent, or they can alternatively be directly added individually and contacted with said matrix product, gas bubble-generating agent and cross-linking agent.

If they are present, the concentration of inorganic oxidizer in granular form, or of the mixture of inorganic oxidizer in granular form, and fuel material in the mixture which is loaded into the blast hole is less than or equal to 70% by weight with respect to said mixture, preferably less than or equal to 60% by weight.

The inorganic oxidizer in granular form as well as the liquid or solid fuel material, or the mixture made up of the inorganic oxidizer in granular form and the liquid or solid fuel material are transported to the explosive mixture "on-site" manufacturing site in suitable containers such as tanks. Although the mixture of the inorganic oxidizer in granular form and the liquid or solid fuel material could be transported, in practice it is advantageous and preferable to transport the components of said mixture, i.e., the inorganic oxidizer in granular form and the liquid or solid fuel material, individually in containers or tanks suitable for said components.

The mixture which is loaded into the blast hole can optionally contain a liquid fuel material. This liquid fuel material can be an aromatic hydrocarbon, an aliphatic hydrocarbon, an oil, a petroleum product, a product of plant origin, etc., and mixtures of said products. The concentration of the liquid fuel material can range between 0% (when it is not present in the mixture which is loaded into the blast hole) or greater than 0% and 20% (when it is present in said mixture which is loaded into the blast hole) by weight, preferably between 2% and 10% by weight with respect to the mixture which is loaded into the blast hole. Where appropriate, the liquid fuel material is transported to the final explosive mixture "on-site" manufacturing site in a suitable container, preferably a tank.

In a particular embodiment, the method of the invention comprises mixing (i) the matrix product with (ii) the gas bubble-generating agent, (iii) the cross-linking agent, and also with one or more of the following products: (iv) a pH-regulating agent, (v) a gas/air bubble-stabilizing agent, (vi) an inorganic oxidizer in granular form or a mixture of an inorganic oxidizer in granular form and a liquid or solid fuel material, and (vii) a liquid fuel material. In a practical embodiment of this particular embodiment, the matrix product (i) and, where appropriate, the gas bubble-stabilizing agent (v), the inorganic oxidizer in granular form or the mixture of the inorganic oxidizer in granular form and the liquid or solid fuel material (vi) and the liquid fuel material (vii) are mixed in a suitable mixer such as a rotary mixer, preferably an auger, where atmospheric air bubbles can be incorporated by means of entrapping if the gas bubble-stabilizing agent (v) has been incorporated. The gas bubble-generating agent (ii), the cross-linking agent (iii) and optionally the pH-modifying agent (iv) can be incorporated to the mixture in said rotary mixer or in the pump used for loading the blast holes with the obtained mixture. After mixing the mentioned components, the obtained mixture has an oxygen balance between −10% and +10% before loading in the blast holes and can be conveyed by means of an auger or by means of a pump. The mixture which is loaded into the blast hole looks granular/pasty, being unloaded into the blast holes by means of an auger, or it looks like a viscous liquid, being unloaded into the blast holes by means of a pump. After unloading the mixture in the blast holes, the mixture evolves inside the blast holes until turning into the water-resistant low-density water-gel explosive and acquiring its final properties or characteristics inside the blast hole.

As indicated, at the time of loading into the blast holes, the obtained mixture looks like a granular/pasty sticky solid or a viscous liquid with a density comprised between 1.0 and 1.4 g/cm$^3$. The chemical reaction that generates the gas bubbles occurs primarily once the mixture is inside the blast hole. Once gas bubble generation ends, the density of the water-gel explosive is comprised between 0.2 and 1.2 g/cm$^3$, preferably between 0.3 and 1.1 g/cm$^3$, at atmospheric pressure, i.e., it is a low-density water-gel explosive. The reaction resulting in the cross-linking of the polymer contained in the matrix product also occurs primarily once the mixture obtained in b) is introduced inside the blast hole. The mechanism of this reaction results in a progressive increase in the number of chemical bonds between the different polymer chains. Once a specific value in the number of cross-linking nodes is achieved, virtually all the polymer chains are bound to one another forming a three-dimensional network that gives the final explosive the characteristics typical of a flexible solid. The concentration of the cross-linking agent determines the number of nodes of this three-dimensional network. The larger this number is, the greater the elasticity modulus of the gel will be, and therefore the greater the consistency of the resulting solid explosive will be. The significant mechanical strength of this gel is the reason for the water resistance of the explosive and for the mechanical stability of the explosive column, despite the low-density thereof. Generally, as will be understood by the person skilled in the art, the volume occupied by the non-explosive or low-sensitivity matrix and the gas/air occluded therein is greater than the volume occupied by the inorganic oxidizer in granular form that is optionally incorporated.

In addition to controlling the magnitude of the gassing and cross-linking reactions, according to the invention it is very important to regulate the kinetics of both reactions such that the gassing reaction is significantly faster than the cross-linking reaction because once the three-dimensional polymer network is formed, the dimensions of the solid that is formed are fixed, preventing its expansion and preventing the density from dropping to the prefixed value. To accelerate the gas generation kinetics, catalysts of this reaction can be used. Therefore, if sodium nitrite is used as a bubble-generating agent, catalysts such as thiourea or sodium thiocyanate, among others, can be used. The evolution of the kinetics of both reactions (gassing and cross-linking) can be monitored by conventional methods. Virtually any assay which allows monitoring the evolution of the kinetics of the gassing reaction and cross-linking reaction can be used. By way of non-limiting example, assays can be performed in a laboratory with different formulations, temperatures and pHs, monitoring the evolution of the density and consistency of the explosive over time; the ideal formulation, temperature and pH are thus chosen. To check that the mixture which is being introduced in the blast hole works correctly, samples are taken in tared cups during loading and the evolution of the density and consistency is monitored; it is thus possible to know what is happening inside the blast hole such that it is possible to know if the mixture which is loaded into the blast hole is evolving suitably and being turned into the explosive with the desired final characteristics (water-resistant low-density water-gel explosive), and if that is not the case, it is possible to act in order to favor the gassing reaction at the expense of the cross-linking reaction or vice versa.

The method of the invention can be carried out in a truck for loading explosives equipped with the necessary means, having compartments for transporting the mentioned components (i) the matrix product, (ii) the gas bubble-generating agent, and (iii) the cross-linking agent, and optionally the compartments necessary for transporting one or more of the following components: (iv) the pH-regulating agent, (v) the gas/air bubble-stabilizing agent, (vi) the inorganic oxidizer in granular form or a mixture of an inorganic oxidizer and a fuel material in granular form, and (vii) the liquid fuel material.

Figure 2:
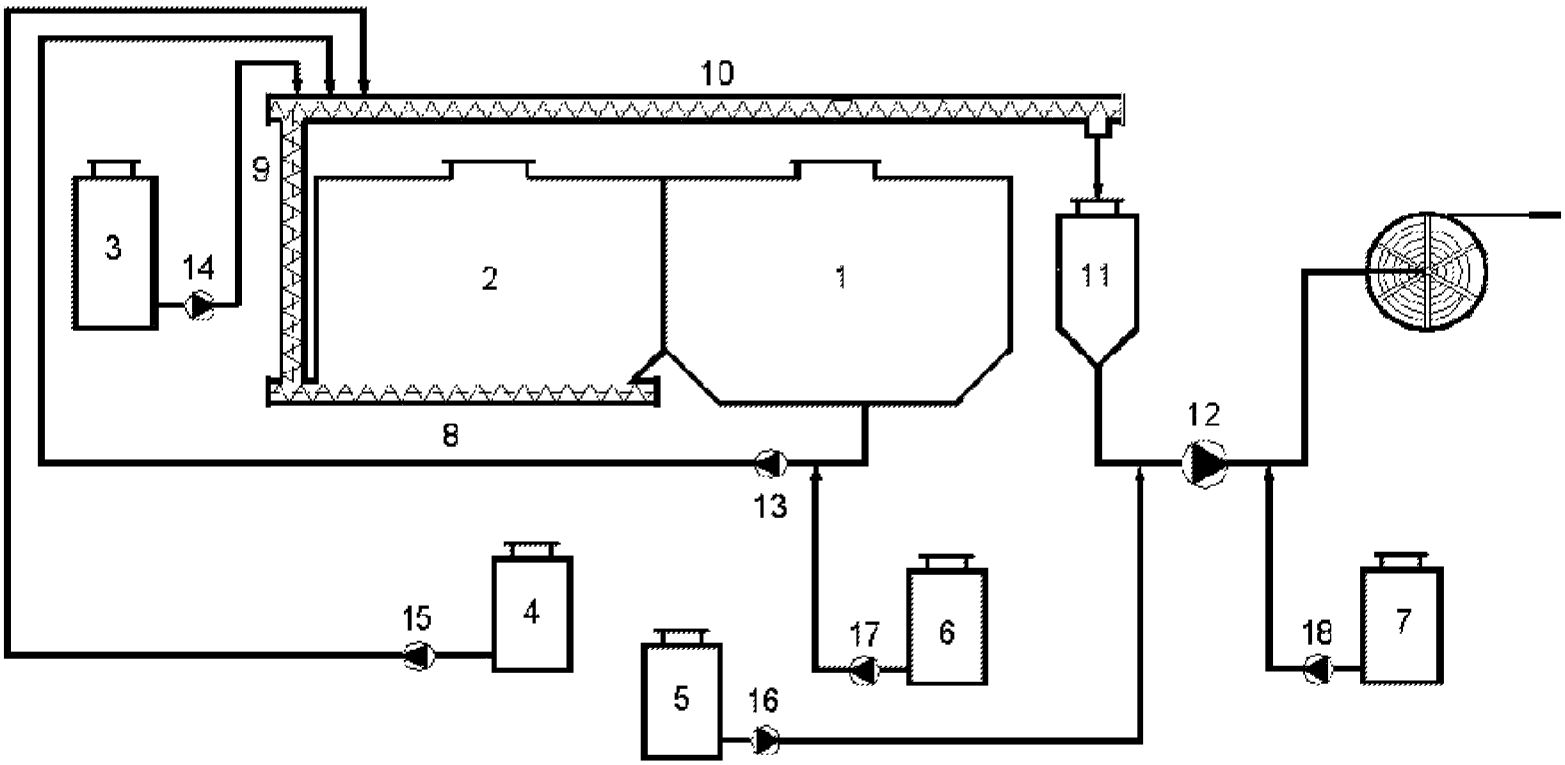

In two particular and preferred embodiments, FIGS. 1 and 2 schematically illustrate putting into practice the method for the "on-site" manufacture of a water-based explosive of the water-gel type provided by this invention when it is carried out in two types of truck for loading blast holes:

a) Type 1 truck six tanks where the different components can be stored, specifically a tank (1) for the non-explosive or low-sensitivity matrix product, a tank (2) for the inorganic oxidizer in granular form, a tank (3) for the liquid fuel material, a tank (4) for the gas bubble-generating agent, which can optionally be used simultaneously for the gas/air bubble-stabilizing agent, a tank (5) for the cross-linking agent, and a tank (6) for the pH-regulating agent;

an auger (8) for metering the inorganic oxidizer in granular form;

an auger (9) for driving the inorganic oxidizer in granular form to the auger (10);

an auger (10) acting as a rotary mixer and unloading the mixture into the blast hole;

a pump (13) for metering the matrix product;

a pump (14) for metering the liquid fuel material;

a pump (15) for metering the gas bubble-generating agent, and optionally for metering the gas/air bubble-stabilizing agent at the same time;

a pump (16) for metering the cross-linking agent; and a pump (17) for metering the pH-regulating agent.

b) Type 2 truck seven tanks where the different components can be stored, specifically a tank (1) for the non-explosive or low-sensitivity matrix product, a tank (2) for the inorganic oxidizer in granular form, a tank (3) for the liquid fuel material, a tank (4) for the gas bubble-generating agent which can optionally be used simultaneously for the gas/air bubble-stabilizing agent, a tank (5) for the cross-linking agent, a tank (6) for the pH-regulating agent, and a tank (7) for the hose lubricating liquid;

an auger (8) for metering the inorganic oxidizer in granular form;

an auger (9) for driving the inorganic oxidizer in granular form to the auger (10);

an auger (10) acting as a rotary mixer and unloading the formed mixture into the hopper (11) of the pump (12) whereby the final mixture is pumped to the bottom of the blast hole;

a pump (12) which, in addition to pumping the final mixture to the bottom of the blast hole, mixes the cross-linking agent with the rest of the mixture coming from the auger (10);

a pump (13) for metering the matrix product;

a pump (14) for metering the liquid fuel material;

a pump (15) for metering the gas bubble-generating agent and optionally for metering the gas/air bubble-stabilizing agent at the same time;

a pump (16) for metering the cross-linking agent;

a pump (17) for metering the pH-regulating agent; and a pump (18) for metering the liquid forming the lubricating ring along the hose, the pumping pressure of the final mixture which is unloaded into the blast hole thus being reduced.

Evidently, a type 2 truck (b) could perform the same particular method as a type 1 truck (a). In that case, the pump (16) would meter the cross-linking agent to the mixing auger (10) instead of to the suction side of the pump (12), and this auger (10) would unload the final mixture directly into the blast hole instead of the hopper (11). The hose lubricating liquid can be virtually any liquid which forms a lubricating ring along the hose and allows reducing the pumping pressure of the final mixture which is unloaded into the blast hole, for example water, etc.

In addition to producing a water-resistant low-density water-gel explosive that can be conveyed by means of augers and/or pumps, such as augers or pumps commonly used in the "on-site" production of explosives, the method for the "on-site" manufacture of a water-based explosive provided by this invention has the advantage that it allows varying the density and the mechanical strength of the explosive. At the same time, it also allows varying the proportions of the mixture to adjust the energy thereof to the requirements of each application. Another advantage of the method of the invention relates to the low production cost of the water-resistant low-density water-gel explosive. The method of the invention can operate continuously or discontinuously (batchwise).

The invention is illustrated by means of the following two examples which in no case limit the scope of the invention.

Example 1

The explosive product (mixture which can be conveyed by an auger) described in this example is manufactured in an installation located on a truck consisting of the following elements according to FIG. 1:

- an 8,000 1 tank (1) where the non-explosive or low-sensitivity matrix product (matrix suspension) is stored;
- a 10,000 1 tank (2) where the inorganic oxidizer in granular form is stored;
- a 1,000 1 tank (3) for the liquid fuel material;
- a 200 1 tank (4) for storing the gas bubble-generating agent and optionally the gas/air bubble-stabilizing agent;
- a 200 1 tank (5) where the cross-linking agent is stored;
- a 100 1 tank (6) where the pH-regulating agent is stored;
- an auger (8) for metering the inorganic oxidizer in granular form;
- an auger (9) for driving the inorganic oxidizer in granular form to the auger (10);
- four pumps (13, 14, 15, 16) for metering and conveying the matrix suspension, the liquid fuel material, the gas bubble-generating agent and the cross-linking agent, respectively, to the mixing auger (10); and
- a pump (17) metering and sending the pH-regulating agent to the inlet of the pump (13) for the matrix suspension. The matrix suspension and the pH-regulating agent are mixed in this pump.

In addition to forming the final mixture, the auger (10) unloads said final mixture directly into the blast hole.

The tank (1) was filled with a matrix suspension the composition of which is described in Table 1.

TABLE 1

Composition of the matrix suspension

| Component | % |
|---|---|
| Water | 11.7 |
| Ammonium nitrate | 67.8 |
| Monomethylamine nitrate | 14.5 |
| Ethylene glycol | 5.0 |
| Guar gum | 0.8 |
| Thiourea | 0.2 |

This suspension is made up of an ammonium nitrate and monomethylamine nitrate-saturated aqueous solution and of small ammonium nitrate particles in suspension, said suspension being stabilized with guar gum. The density of this matrix product was 1.50 g/cm$^3$.

Tanks (2), (3), (4), (5) and (6) were filled with porous ammonium nitrate, gas oil, a 30% sodium nitrite solution, a 1% potassium pyroantimonate solution and a 40% acetic acid solution, respectively.

Before starting the manufacture, the auger for metering the inorganic oxidizer (8) and the pumps for metering the matrix product (13), liquid fuel material (14), gas bubble-generating agent (15), cross-linking agent (16) and pH-regulating agent (17) were calibrated. Table 2 shows the manufacturing conditions used.

TABLE 2

Operating conditions

| | |
|---|---|
| Mixing auger (rpm) | 350 |
| Matrix suspension (kg/min) | 150 |
| Ammonium nitrate (kg/min) | 150 |
| Gas oil (l/min) | 11.2 |
| Sodium nitrite solution (l/min) | 4.1 |
| Potassium pyroantimonate solution (l/min) | 3.4 |
| Acetic acid solution (l/min) | 1.5 |

Upon exiting the mixing screw, the explosive product was dropped into the blast holes which were 10" (254 mm) in diameter and about 31 m deep. A sample of the final mixture was taken at the outlet of the mixing screw (10) to know the evolution of the density and consistency of the explosive product over time. The collected explosive sample had a density of 0.59 g/cm$^3$ after 30 minutes and of 0.51 g/cm$^3$ after 60 minutes. An increase in sample viscosity was observed after 40 minutes and the initial fluid mixture had turned into a water-gel type solid explosive after 120 minutes.

Figure 3:
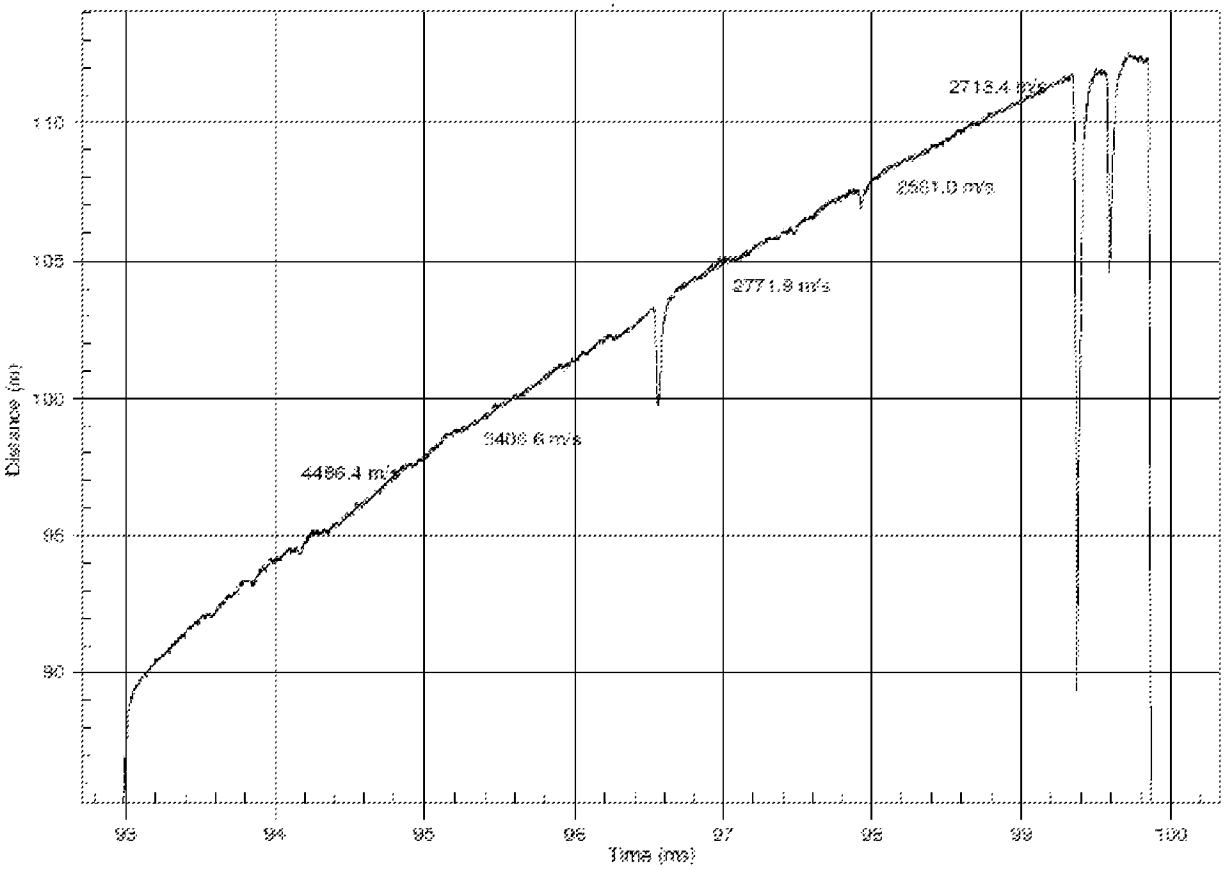
FIG. 3 is a graph showing the variation in explosive detonation velocity along the explosive column obtained in Example 1.

An explosive column of 25 m was finally obtained, the average density of which was 0.70 g/cm$^3$. The final explosive product was detonated, initiated with a 450 g pentolite booster. The variation in detonation velocity of the explosive along the explosive column can be observed in FIG. 3. The reduction in detonation velocity as the detonation front moves up along the explosive column is due to the fact that the density of the explosive increases as it descends further into the blast hole due to the hydrostatic pressure which compresses the gas bubbles contained by the explosive. A velocity of 4.5 km/s was obtained at the bottom of the blast hole where the density was higher, and a velocity of 2.6 km/s was measured at the top part of the blast hole. Therefore, a low-density explosive which also has a low detonation velocity is successfully manufactured with the method described in the invention.

Example 2

The explosive product (mixture which can be conveyed with a pump) described in this example is manufactured in an installation located on a truck consisting of the following elements according to FIG. 2:

- an 8,000 1 tank (1) containing the non-explosive or low-sensitivity matrix product (matrix suspension);
- a 10,000 1 tank (2) where the inorganic oxidizer in granular form is stored;
- a 1,000 1 tank (3) for the liquid fuel material;
- a 200 1 tank (4) for storing the gas bubble-generating agent and optionally the gas/air bubble-stabilizing agent;
- a 200 1 tank (5) where the cross-linking agent is stored;
- a 100 1 tank (6) where the pH-regulating agent is stored;
- an auger (8) for metering the inorganic oxidizer in granular form;
- an auger (9) for driving the inorganic oxidizer in granular form to the auger (10);

three pumps (13, 14, 15) for metering and conveying the matrix suspension, the liquid fuel material and the gas bubble-generating agent, respectively, to the mixing auger (10);

a pump (17) metering and sending the pH-regulating agent to the suction side of the pump (13) for the matrix suspension. The matrix suspension and the pH-regulating agent are mixed in this pump;

a pump (16) metering and sending the cross-linking agent to the suction side of the pump (12) for the final mixture; and a pump (12) suctioning the final mixture from a hopper (11) where the mixture produced in the mixing auger (10) falls for pumping said final mixture to the bottom of the blast holes. The product formed in the mixing auger (10) and the cross-linking agent are mixed in this pump.

Tanks (1), (2), (3), (4), (5) and (6) were loaded with the same products as in Example 1. Before starting the manufacture, the different metering devices were calibrated in a manner similar to Example 1. Table 3 shows the manufacturing conditions used.

TABLE 3

| Operating conditions | |
|---|---|
| Mixing auger (rpm) | 250 |
| Matrix suspension (kg/min) | 140 |
| Ammonium nitrate (kg/min) | 60 |
| Gas oil (l/min) | 4.5 |
| Sodium nitrite solution (l/min) | 2.8 |
| Potassium pyroantimonate solution (l/min) | 3.2 |
| Acetic acid solution (l/min) | 1.2 |

The final mixture was pumped with the pump (12) to the bottom of the blast holes which were 5" (127 mm) in diameter and about 13 m deep. To facilitate the pumping, the loading hose was lubricated with water coming from the tank (7). A pump (18) metered and sent the water to the outlet of the pump (12). A sample of the final mixture was taken at the outlet of the loading hose to know the evolution of the density and consistency of the explosive product over time. The collected explosive sample had a density of 0.51 g/cm$^3$ after 30 minutes and a density of 0.39 g/cm$^3$ after 60 minutes. An increase in sample viscosity was observed after 35 minutes and the initial fluid mixture had turned into a water-gel type solid explosive after 120 minutes.

Figure 4:
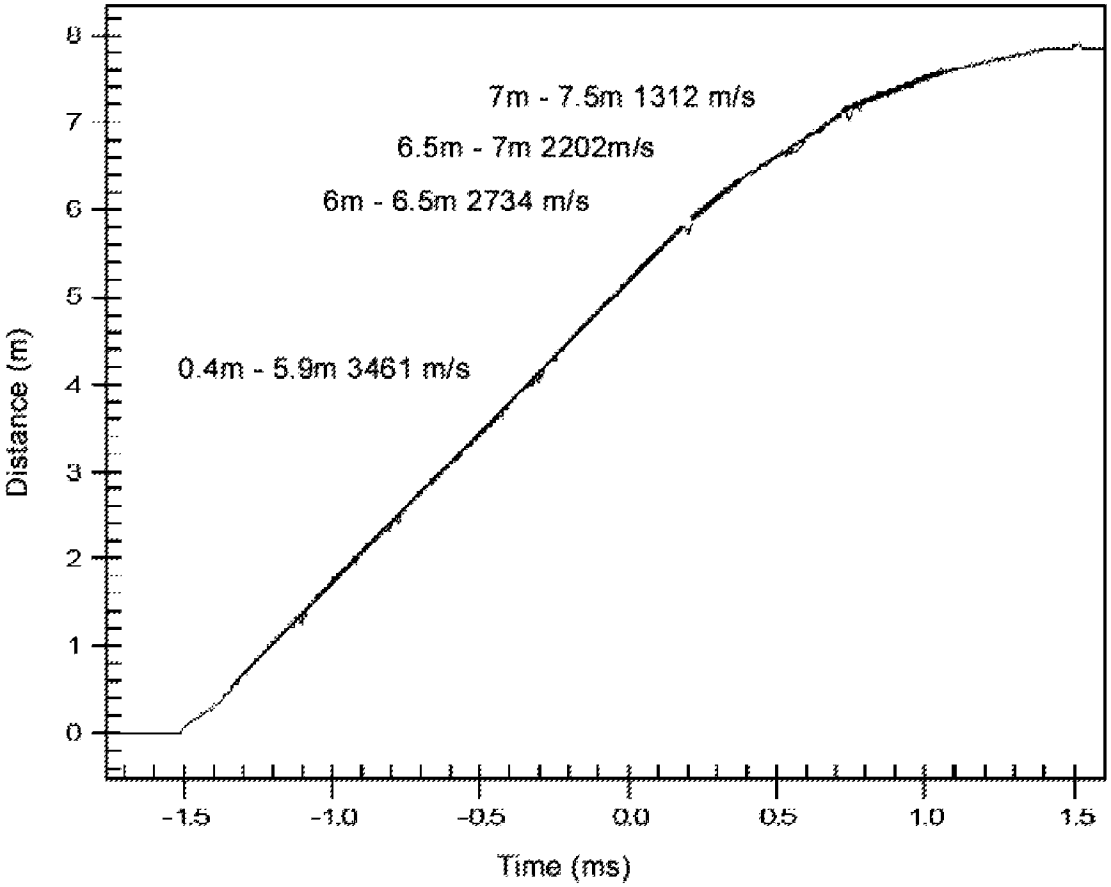
FIG. 4 is a graph showing the variation in explosive detonation velocity along the explosive column obtained in Example 2.

An explosive column of 9 m was finally obtained, the average density of which was 0.44 g/cm$^3$. The final explosive product was detonated, initiated with a 450 g pentolite booster. The variation in detonation velocity of the explosive along the explosive column can be observed in FIG. 4. A velocity of 3.4 km/s was obtained at the bottom half of the blast hole where the density was higher, and a velocity of 1.3 km/s was measured at the top part of the explosive column. This low detonation velocity is due to the fact that the explosive had an exceptionally low-density (0.39 g/cm$^3$) at the top part of the blast hole.

The invention claimed is:

1. A method for the continuous "on-site" manufacture of a water-resistant low-density water-gel explosive, which comprises:

a) transporting to the manufacturing site:

(i) a non-explosive or low-sensitivity matrix product comprising an aqueous solution or suspension of at least one oxidizing salt, and at least one cross-linkable water-soluble polymer;

(ii) a gas bubble-generating agent; and (iii) a cross-linking agent capable of cross-linking said cross-linkable water-soluble polymer contained in said matrix;

b) mixing said products (i), (ii) and (iii) in at least one device with mixing capability to obtain a mixture which is conveyed by means of a pump and/or an auger;

c) loading the mixture resulting from b) directly in the blast hole by means of a pump or an auger; and d) generating gas bubbles by means of said gas bubble-generating agent and cross-linking said polymer by means of said cross-linking agent within the mixture already introduced in the blast hole, under conditions in which the chemical cross-linking process and the chemical bubble-generating process occur primarily once the mixture is inside the blast hole, the chemical cross-linking process forms a fixed three dimensional network solid that is unable to expand after the chemical bubble-generating process is complete, and wherein the final density of the explosive mixture is regulated with the concentration of the gas bubble-generating agent and the final physical consistency of the explosive is regulated with the cross-linking agent.

2. The method according to claim 1, wherein said water-gel explosive has a density comprised between 0.2 and 1.2 g/cm$^3$ at atmospheric pressure.

3. The method according to claim 1, wherein at least one of the polymers contained in the non-explosive or low-sensitivity matrix is a gum containing galactomannan.

4. The method according to claim 1, wherein the cross-linking agent is an inorganic compound containing antimony.

5. The method according to claim 1, wherein the gas bubble-generating agent is a nitrous acid salt.

6. The method according to claim 1, further comprising transporting said gas-generating agent (ii)

said cross-linking agent (iii), and a one or more product selected from the group consisting of (iv) a pH-regulating agent, (v) a gas/air bubble-stabilizing agent, (vi) an inorganic oxidizer in granular form or a mixture of an inorganic oxidizer in granular form and a liquid or solid fuel material, (vii) a liquid fuel material, and combinations thereof, to the manufacturing site and mixing same with said non-explosive or low-sensitivity matrix product (i).

7. The method according to claim 1, wherein said non-explosive or low-sensitivity matrix is present in the mixture in a proportion equal to or greater than 30% of the total weight of the mixture.

8. The method according to claim 6, wherein the inorganic oxidizer in granular form is an inorganic nitrate.

9. The method according to claim 6, wherein the liquid fuel is selected from the group consisting of aromatic hydrocarbons, aliphatic hydrocarbons, oils, petroleum products, products of plant origin and mixtures thereof.

10. The method according to claim 6, wherein the gas/air bubble-stabilizing agent is selected from the group consisting of solutions or dispersions of surfactants, proteins and natural polymers and derivatives thereof.

11. The method according to claim 1, wherein the volume occupied by the non-explosive or low-sensitivity matrix and the gas/air occluded therein is greater than the volume occupied by the optional inorganic oxidizer in granular form.

12. The method according to claim 1, wherein said products (i), (ii) and (iii) are mixed in an installation assembled on a truck.

13. The method according to claim 6, wherein said products (i), (ii), (iii) and optionally, (iv), (v), (vi) and/or (vii), are mixed in an installation assembled on a truck.

14. The method according to claim 1, wherein said water-gel explosive has a density comprised between 0.3 and 1.1 g/cm$^3$ at atmospheric pressure.

* * * * *